United States Patent [19]

Bork

[11] Patent Number: 4,745,733

[45] Date of Patent: May 24, 1988

[54] HORSE TACK BIT

[76] Inventor: Gerald R. Bork, 36631 Hathaway, New Baltimore, Mich. 48047

[21] Appl. No.: 12,727

[22] Filed: Feb. 5, 1987

[51] Int. Cl.[4] ..... B68B 1/06

[52] U.S. Cl. ..... 54/7

[58] Field of Search ..... 54/7, 8, 9

[56] References Cited

U.S. PATENT DOCUMENTS

| | | | |
|---|---|---|---|
| 424,258 | 3/1890 | Belknap | 54/7 X |
| 660,923 | 10/1900 | Purcell | 54/7 |
| 891,419 | 6/1908 | Herbert | 54/7 |
| 1,124,108 | 1/1915 | Chenault | 54/7 |

*Primary Examiner*—Robert P. Swiatek

*Attorney, Agent, or Firm*—Basile and Hanlon

[57] ABSTRACT

A horse tack bit comprising: a mouth piece having two ends; two opposed tubular cheek pieces, each of said cheek pieces including an angled shank portion which is attached to an end of the mouthpieces and extends rearwardly downwardly and inwardly therefrom and a flexible portion; a bridle ring disposed at the end of each cheek piece proximate the angled portion thereof; a rein connector; flexible cables extending through the tubular cheek pieces and the ends of the mouthpiece and attached at ends thereof to the rein connector and the bridle reins to hold the bit together; and a spring disposed inside of the flexible portion of each cheek piece. When a set of reins is attached to the rein connector, tensioning the reins in one direction will cause flexion of the bit, thereby turning the head of an animal wearing the bit in the opposite direction of the tension.

12 Claims, 3 Drawing Sheets

HORSE TACK BIT

BACKGROUND OF THE INVENTION

1. Field of the Invention

The invention relates generally to the field of bits usable for controlling the direction of an animal such as a horse, mule or donkey when said animal is being ridden, and more particularly, to a flexible bit which, upon tensioning a set of reins attached thereto on one side of the animal's neck, will flex thereby causing the animal to turn its head in the opposite direction.

2. Description of the Prior Art

The usefulness of horses and other similar animals for the relatively rapid locomotion of a human rider astride the back thereof has been known since approximately 2000 B.C. During this long period of history of horsemanship, various devices have been invented to assist the rider in controlling the animal and causing it to move in the desired direction. The gradual development of more refined control devices has resulted in the now familiar tack arrangement of a bridle comprised of straps which adjustably fit around the animal's head, a metal bit including a mouthpiece adapted to fit in the animal's mouth and extend over and atop its tongue, and a set of reins which are conventionally attached to the bit at either side of the animal's mouth.

In conventional bit design, the ends of the mouthpiece extend out each side of the animal's mouth. The mouthpiece ends are attached to cheek pieces, which provide attachment for the ends of the bridle and the reins. The bit may further comprise extensions of the cheek pieces which extend toward the front of the animal's mouth and, if the reins are attached to the ends thereof, exert a powerful leverage force on the animal's mouth, as with a curb bit. The mouthpiece may comprise a single piece or be jointed in one or more places.

Various bits incorporating some of the features mentioned as well as others are disclosed in U.S. Pat. Nos. 907,816; 804,700; 424,258; 660,923; 479,670; 617,300 and 52,125. In all of these references, and as is conventional in the art, the reins are attached at each side of the animal's mouth either to the cheek pieces or extensions thereof.

Two styles of riding have evolved, both of which have conventionally used bits of the type described above. In English style riding, the set of reins includes a single rein, each end being attached to the bit on each side of the animal's mouth. During riding, one rein is held in each hand on either side of the animal's neck. To direct the animal, one pulls on the right rein to turn the animal right and on the left rein to turn the animal left.

In so-called 37 Western" style riding, instead of using two hands to hold the reins, only one hand is used. In order to direct the animal, the technique of "neck-reining" is employed. To direct the animal right, for example, the hand holding the reins moves the reins to the right, while slightly lifting them, and lays the left rein on the left side of the animal's neck, thereby causing the neck to turn to the right, and the animal to turn in that direction. While this style of riding has the advantage of leaving one hand free for show contests or other activities, such as roping, etc., it has prior to now been usable only with a properly trained animal. The technique of "neck-reining" causes the animal to turn in the direction opposite the side in which the cue is applied. In other words, if the rein is laid on the left side of the animal's neck, the animal must know to turn right. Such a technique is difficult to use with a combination of a conventional bit and an untrained horse because the animal becomes easily confused since pressure is applied to the opposite side of the mouth than the direction in which the horse is being urged.

Thus, while the technique of neck-reining has the advantage of leaving one hand of the rider free and is mandatory in showing western horses, if it is employed in conjunction with the prior art bits described above, it can only be used with a well trained animal. Thus, the limitations of the prior art do not allow a rider to use a one-handed technique with a relatively untrained or greenbroken animal.

It would be desirable to provide an improved bit which allowed the rider to use a one-handed riding style with a relatively untrained or greenbroken horse. It would also be desirable to provide an improved bit which causes the animal to turn its head in the same direction as the direction of pull on the reins. It would also be desirable to provide an improved bit which allows the rider to employ a technique of riding more natural to both the rider and to the animal. Finally, it would be desirable to provide a bit which can easily be adjusted to properly fit the animal.

SUMMARY OF THE INVENTION

The improved bit design of the present invention overcomes all of the limitations described above. The improved bit of the instant invention comprises: a mouth piece having two ends and an aperture formed in each end extending transverse the longitudinal axis thereof; two opposed tubular cheek pieces, each of said cheek pieces including an angled shank portion attached to an end of the mouth piece to extend downwardly and inwardly therefrom, and a flexible portion; a bridle ring disposed at an end of each cheek piece opposite the flexible portion; spring means disposed inside of the flexible portion of each cheek piece; a rein connector connecting the ends of the cheek pieces adjacent the flexible portions thereof; and a flexible connecting means, the ends of which extend from the rein connector and each of the cheek pieces, and are attached to one of the bridle rings to hold the bit together and permit flexing of the cheek and mouthpiece relative to each other. When a set of reins are attached to the rein connector, the rider may direct the movement of the animal by tensioning the reins, which are held in one hand for showing, in the direction in which it is desired to go. The tension of the reins will cause flexion of the bit in the direction of tension and cause the animal to turn its head in the opposite direction.

For example, if the rider desires the animal to go to the right, he will simply pull the reins in a general rightward direction against the left side of the animal's neck. This rightward pull on the reins will cause the bit to flex, and the right cheek piece of the bit will be pulled generally back and upward. This, in turn, will cause the right side of the mouth piece to be pulled downward and to the right. Since the natural tendency of the animal will be to move its head in the direction in which the mouth piece is exerting pressure on the mouth, the animal will turn its head to the right. This, in turn, will cause the animal to turn in that direction. Since the acetion of the bit allows the animal to move in the same direction as it would naturally feel a tendency to go, no extensive training is required, either of the rider or animal.

The bit of the present invention may comprise other elements which enhance the flexibility of the bit and also permit adjustment of its size to fit the mouths of various sized animals and/or provides varying amounts of leverage. The bit may further comprise a Y-shaped rein connector, with the flexible connecting means being comprised of two cables. The end of each cable is detachably attached to one end of the arms of the Y-shaped rein connector, the other end of each cable being detachably attached to a bridle ring. The leg of the Y-shaped ring connector may be angled backward to exert a cantilever effect on the bit when a rein attached thereto is pulled. The flexible portion of each cheek piece may comprise an externally disposed spring to allow flexing of the cheek piece and to provide a shock absorbing action.

A pair of adjustable connectors may be provided, each of which has a bore extending through its longitudinal axis, said bore being offset from the center of the longitudinal extent of the connector. An aperture extends through each adjustable connector in a direction at right angles to that of the bore and also offset from the center line. In this embodiment, each end of the mouth piece has a bore extending therethrough transverse the longitudinal axis of the mouth piece. The ends of the mouth piece may then be slidably inserted through the apertures of the adjustable connectors, with the bores of the mouthpiece aligning with the bores of the adjustable connectors. The two cables may be then passed through the adjustable connectors and the ends of the mouthpiece. When it is desired to adjust the size of the bit, the ends of the adjustable connectors may be detached from the bridle rings by compression of the internal springs of the cheek pieces to permit ready disassembly. By reversing the adjustable connectors end to end, side to side, or both, the size and leverage of the bit may be adjusted either with reference to its length or to its width.

A method of controlling the direction of a horse while being ridden is also disclosed herein. The method comprises the steps of outfitting the horse with a bridle attached to a bit constructed as disclosed above. A set of reins is attached to the Y-shaped ring connector. By exerting tension on the reins on one side of the horse's neck, the bit is flexed and cantilevered, thereby turning the horse's head in the opposite direction of neck tension. This method of controlling the direction of the horse may be used even with a greenbroken or relatively untrained horse. However, the above method of riding a horse using the improved bit of the instant invention finds greater utility with a horse trained in the "neck-reining" style of control since less tension on the reins is required because pressure is applied to the proper side of the animal's mouth.

BRIEF DESCRIPTION OF THE DRAWING

The various features, advantages and other uses of the present invention will become more apparent by referring to the following detailed description and drawing in which.

DETAILED DESCRIPTION OF THE PREFERRED EMBODIMENTS

Figure 1:
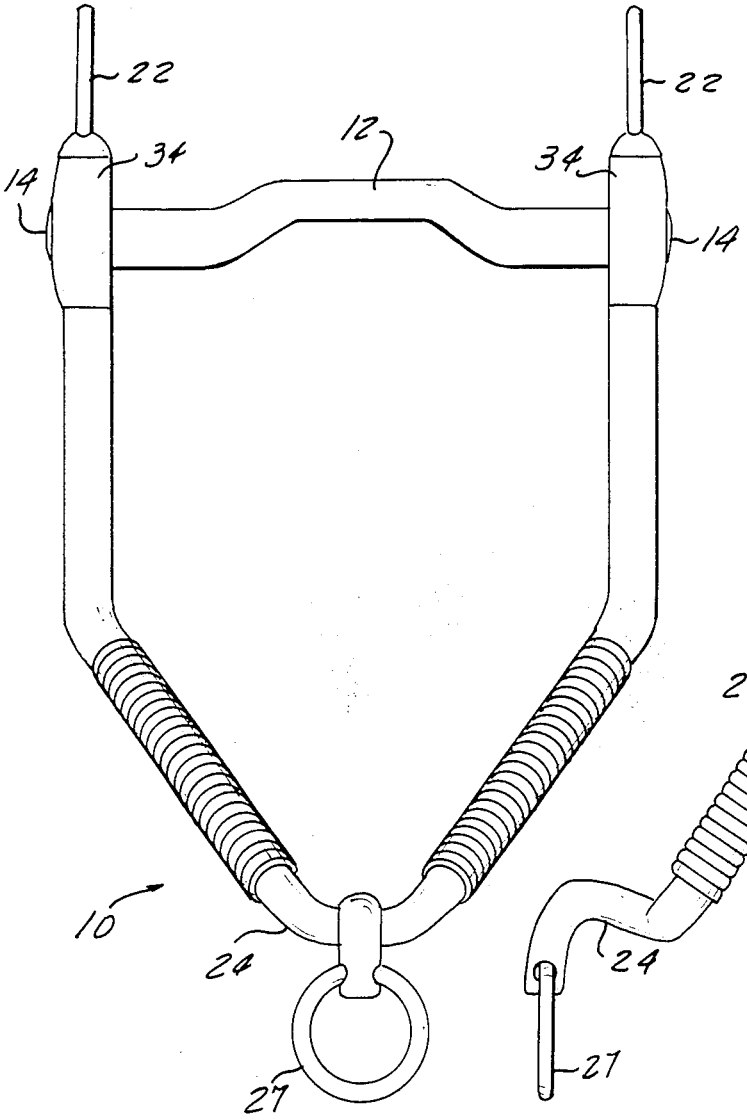
FIG. 1 is an elevational view of a bit constructed in accordance with the instant invention shown in a position mounted on a horse.

Throughout the following description and drawing, identical reference numbers are used to refer to the same components in multiple figures of the drawing.

Figure 2:
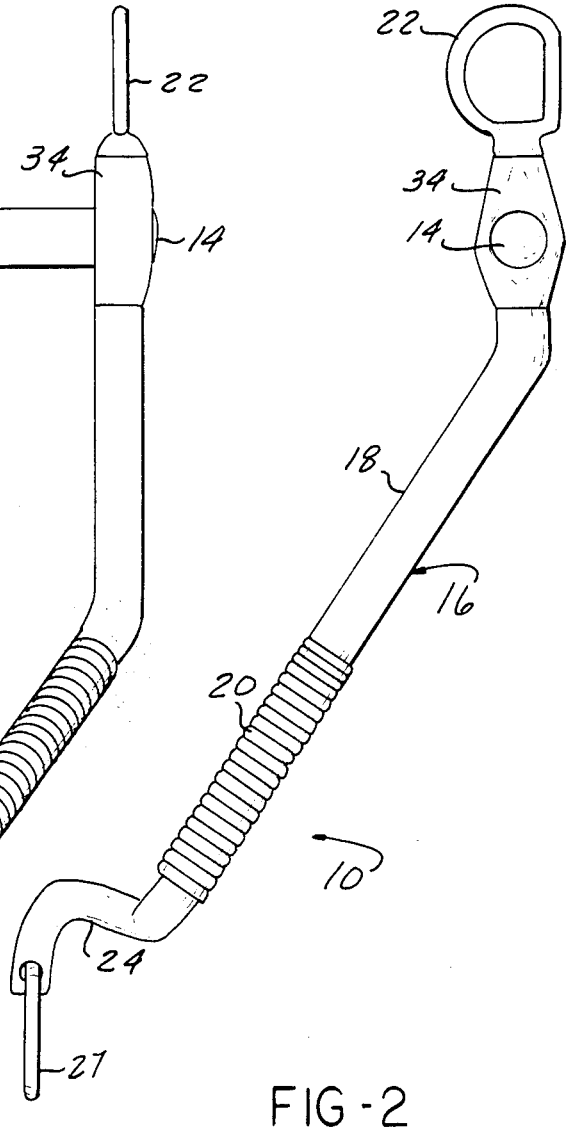
FIG. 2 is a right hand elevational view of the bit of FIG. 1.
Figure 3:
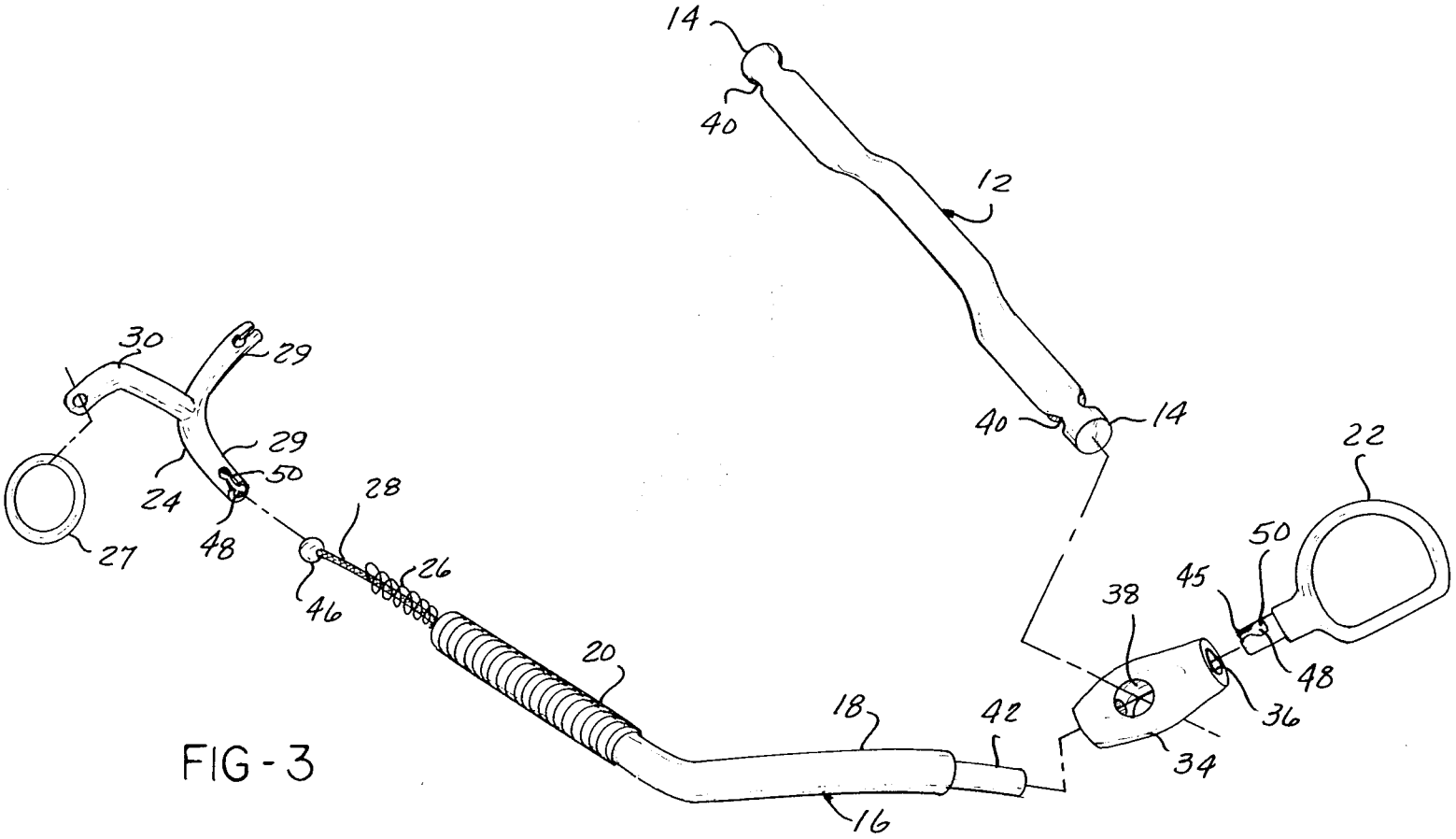
FIG. 3 is an exploded view of the bit of FIG. 1 illustrating the arrangement of the parts thereof.

Referring now to the drawing, and to FIGS. 1, 2 and 3 in particular, there is illustrated a horse tack bit 10. The horse tack bit 10 comprises a mouth piece 12 which has two ends 14. The mouthpiece 12 is shaped in a conventional fashion to fit in the mouth of an animal such as a horse, with a shaped middle portion fitting over the tongue and extending across the mouth of the animal. As may be seen in FIG. 3, each end 14 of the mouth piece 12 has a bore 40 extending therethrough. The purpose of the bores 40 will be explained later.

The horse tack bit 10 further comprises two opposed tubular cheek pieces 16, each of said cheek pieces including an angled shank portion 18 and a flexible portion 20. The opposed tubular cheek pieces 16 are attached to each side of the mouth piece 12 by means of a pair of adjustable connectors 34. The adjustable connectors 34 each have a bore 36 extending therethrough in the direction of the longitudinal axis thereof. The bores 36 are slightly offset from the center line of the adjustable connectors 34. Also extending through each adjustable connector 34 and in a direction transversely to that of bore 36 is an aperture 38. Aperture 38 is also offset with respect to the center line of adjustable connector 34.

When an end 14 of mouthpiece 12 is threaded through the aperture 38 located in one of the adjustable connectors 34, the bore 40 adjacent the end 14 of the mouthpiece 12 will come into alignment with the bore 36 formed in the adjustable connector 34. A portion of a reduced diameter 42 formed at the end of each tubular cheek piece 16 adjacent shank 18 may be then inserted into bore 36 near one end of adjustable connector 34, as well as into bore 40.

A pair of bridle rings 22 are also provided. The bridle rings 22 also have formed on one end thereof an area of reduced diameter 45 which may be inserted into bore 36 at the end of adjustable connector 34 opposite the end occupied by the cheek piece 16.

Figure 4:
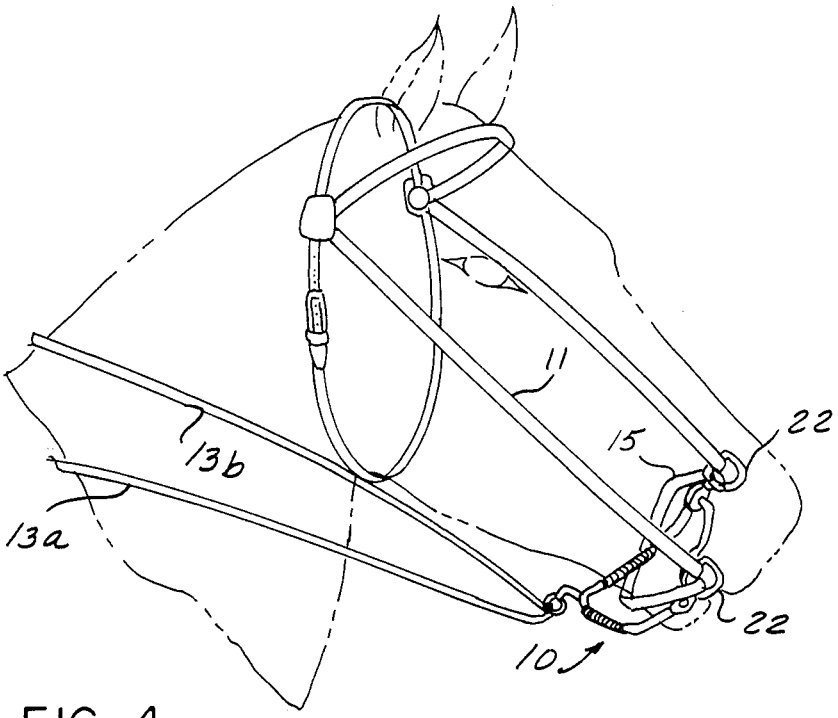
FIG. 4 illustrates the bit of FIG. 1 with a bridle and reins attached thereto and fitted onto the head of a horse.

Cheek pieces 16 are shaped such that, when they are fitted into ends 14 of mouth piece 12, the angled shank portions 18 of cheek pieces 16 extend rearwardly, downwardly and inwardly from mouthpiece 12. The shape of cheek pieces 16 is such that, when cheek pieces 16 are attached to mouth piece 12, the assembled bit will fit around the jaw of the animal and extend downward and rearward therefrom, with the flexible portion 20 of cheek pieces 16 extending inwardly toward each other. To connect cheek pieces 16 at the ends adjacent the flexible portions 20, a Y-shaped rein connector 24 is provided. The arms 29 of the rein connector 24 are adapted to be inserted into the ends of the cheek pieces 16 adjacent the flexible portions 20 thereof. The leg portion 30 of Y-shaped rein connector 24 is angled in the manner shown in FIGS. 2 and 3 to provide a cantilever effect on the bit, as will be described further on. Attached to the free end of the leg 30 is a bridle or rein ring 27 adapted for the attachment of a set of reins 13*a* and 13*b* thereto, as is shown in FIG. 4.

Referring in particular to FIG. 3, a pair of flexible cables 28 are provided. FIG. 3 depicts only the right side cable 28 of the bit 10, but it is understood that the bit 10 is symmetrical with respect to the right and left hand sides, and that the right hand structures in FIG. 3 are duplicated on the left hand side of the bit 10. Flexible connecting means or cables 28 serve the purpose of holding the various pieces of bit 10 together. As depicted in FIG. 3, each flexible cable 28 has formed on each end thereof a spherical member 46. Only one such spherical member 46 may be seen in FIG. 3, on the end of flexible cable 28 extending out of one end of cheek piece 16. Since the length of flexible cable 28, when bit 10 is in the disassembled state is shorter than the length of cheek piece 16 the other spherical member 46 formed on the other end of flexible cable 28 does not extend outside of the other end of cheek piece 16. Slots 48 formed on both the ends of the arms 29 of Y-shaped rein connector 24 and the ends of bridle rings 22 are adapted to slidingly receive the ends of the flexible cable 28 and engage the spherical members 46 formed thereon. Because slots 48 are each formed with a rounded portion 50 adapted to engage spherical member 46, the bit 10 may be assembled by first sliding one end of each flexible cables 28 in a slot 48 until the spherical portion 46 is engaged with a rounded portion 50. The other end of each flexible cables 28 is then passed through tubular cheek piece 16, and bores 40 of mouthpiece 12 and 36 of adjustable connector 34, whereupon the other end is attached to bridle ring 22 by engagement of spherical member 46 with slot 48 and rounded portion 50 described above. Due to the respective lengths of flexible cable 28 and cheek piece 16, the various parts of the bit will remain securely fastened together because flexible cable 28 must be initially compressed to secure both of its ends.

The bit 10 may be easily disassembled and adjustments made in the size thereof in the following manner. The flexible portion 20 which includes an interiorly disposed spring means 26 is compressed to shorten the length of each cheek piece 16. Because of the shortened length of each cheek piece 16, each flexible cable 28 disposed therein will become longer with respect to the cheek piece 16. The spherical members 46 on each end of each flexible cable 28 may be then disengaged from the slots 48 and rounded portions 50 by reversing the steps described above. The length and leverage, for example, of bit 10 may be adjusted by reversing both of the adjustable connectors 34 end to end. Because the bore 38 is off center, the bit 10 will be either longer or shorter relative to the center line of the mouth piece 12 depending upon whether the longer or shorter end of connector 34 is disposed on the end of the cheek piece 16. As shown in FIG. 3, the shorter end of the adjustable connectors 34 is shown adjacent the cheek piece 16. If the bit 10 is assembled with the adjustable connector 34 in this orientation, the bit 10 will be shorter along the length of the cheek pieces 16. Similarly the width of the bit 10 may be adjusted because the bore 36 is off center. By disposing the wider side of the adjustable connector 34 next to the mouthpiece 12, a wider bit may be assembled.

The operation of the bit 10 while in use for horseback riding will now be described. In FIG. 4, a bridle 11 is shown attached to the bridle rings 22. A curb strap 15 is connected between the rings 22. Reins 13*a* and 13*b* are shown attached to the rein ring 27 of bit 10. The bridle and bit are shown in place on a horse's head, with reins 13*a* and 13*b* extending on either side of the animal's neck. It may be understood that the bridle depicted is only chosen by way of example, and any other bridle design, of which there are many, may be selected with equally good results. The ends of the reins 13*a* and 13*b* are shown separately. It is to be understood that they could also be attached to each other to form a single rein.

Figure 6:
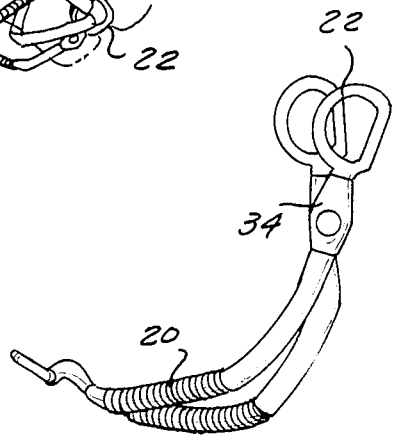
FIGS. 5 and 6 illustrate the flexion of the bit of FIG. 1 when it is under tension from a left side pull of one of the reins.
Figure 5:
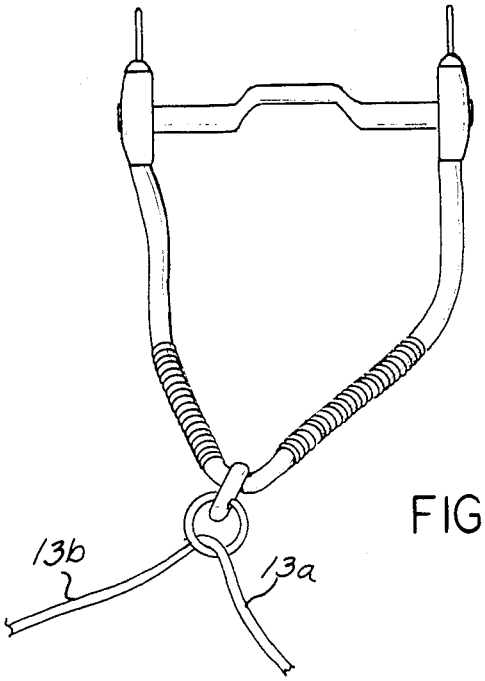

As is shown in FIGS. 5 and 6, when one of the reins 13*a* or 13*b* is pulled to one side of the animal's neck, in this case to the left side, the bit 10 will be flexed in the manner shown. The bit 10 will be flexed to the left, and the angled shank portion of the right side cheek piece 16 will be forced forward. This in turn will cause the left side cheek piece 16 to pivot backward. Because the horse's mouth is subjected to pressure to the right, the horse will turn its head to the right. This rightward turning of the head will cause the entire animal to turn in the rightward direction. Although not depicted, pressure on the right hand side will cause similar flexion of the bit to the right, causing the cheek piece 16 to move to the left. This will cause the horse to then turn left.

It has been found that using the improved bit of the instant invention with a greenbroken or relatively untrained horse will permit easy, one-handed control of the animal. As mentioned above, this has heretofore not been possible. The bit of the instant invention takes advantage of the natural tendency of the animal to turn its head in the same direction in which pressure is exerted. The horse does not have to learn that pressure on the left side of the neck when "neck-reining" really means for the horse to turn to the right. Thus, the action of the bit of the instant invention is more natural and causes less confusion to both animal and rider.

The inventor has also used the improved bit design with well trained and experienced animals who have previously been trained to neck rein. Even though the action of the bit is completely opposite from that of conventional bits, it has been found that the leg time for the well trained horse to re-learn the operation of the new bit has been virtually nil. Even horses used to the other methods have readily adapted to the method of using the improved bit of the instant invention.

In summary, there has been disclosed and described an improved design for a horse tack bit. The improved design capitalizes on the natural tendency of the horse to turn its head in the direction in which its mouth feels pressure. In order to accomplish this, the bit of the instant invention is made to flex in the opposite direction from which the neck pressure is applied. Instead of having cheek pieces disposed on either side of the mouth and unconnected to each other, the cheek pieces of the instant bit are connected by a rein connector. The bit may be also easily disassembled for cleaning and quick adjustments in its length and width readily made.

What is claimed is:

1. A bit for use in riding an animal said bit comprising:

a mouthpiece having two ends;

two opposed tubular cheekpieces, each of said cheekpieces including an angled shank portion attached to an end of the mouthpiece and extending rearwardly, downwardly and inwardly therefrom and a flexible portion;

a bridle ring disposed at an end of each cheekpiece proximate the angled portion thereof;

a connector disposed at an end of each cheekpiece proximate the flexible portion thereof and having opposed arms and a central leg angularly disposed with respect to the arms;

a flexible connecting means extending through the cheekpieces for connecting the bridle rings to the arms of the connector; and wherein when a set of reins is attached to the connector, tensioning the reins in one direction indicating a turn in a direction opposite from the direction of tension will cause the connector to exert a cantilever action on the cheekpiece and associated bridle ring opposite from the direction of tension with respect to the other cheekpiece causing pressure to be applied to the animal's head opposite from the direction of tension, thereby turning the animal's head in the opposite direction of the tension.

2. The bit of claim 1 where the flexible portion of each cheek piece comprises an externally disposed spring.

3. The bit of claim 1 wherein the flexible connecting means is detachably connectable to the bridle rings and the arms of the connector.

4. The bit of claim 3 further including biasing means, disposed internally within the flexible portion of the cheekpieces, for biasing the bit to its normal position and allowing its movement for assembly and disassembly.

5. The bit of claim 1 further including:

a rein ring attached to the leg of the connector for attaching a set of reins to the connector.

6. A bit for use in riding an animal, said bit comprising:

a mouthpiece having two ends;

two opposed tubular cheekpieces, each of said cheekpieces including an angled shank portion attached to an end of the mouthpiece and extending rearwardly, downwardly and inwardly therefrom and a flexible portion:

a bridle ring disposed at an end of each cheekpiece proximate the angled portion thereof:

a rein connector formed of a Y-shaped piece having opposed arms and a center leg a flexible connecting means including two cables extending at least partially through the rein connector and through the cheekpieces and attached to the bridle rings for holding the bit together and for permitting flexing of the cheek and mouthpiece relative to each other, an end of each cable being detachably attached to one end of the arms of the Y-shaped piece, the other end of each cable being detachable attached to a bridle ring; and spring means disposed inside of the flexible portion of each cheekpiece, wherein, when a set of reins is attached to the rein connector, tensioning the reins in one direction will cause flexion of the bit, thereby turning the animal's head in the opposite direction of the tension.

7. The bit of claim 6 further comprising a rein ring attached to the leg of the Y-shaped piece, the leg of the Y-shaped piece being angled backward and downward to exert a cantilever effect on the bit when a rein attached thereto is pulled.

8. A bit for use in riding an animal, said bit comprising:

a mouthpiece having two ends;

two opposed tubular cheekpieces, each of said cheekpieces including an angled shank portion attached to an end of the mouthpiece and extending rearwardly, downwardly and inwardly therefrom and a flexible portion comprised of an externally disposed spring:

a bridle ring disposed at an end of each cheekpiece proximate the angled portion thereof;

a rein connector;

a flexible connecting means extending at least partially through the rein connector and through the cheekpieces and attached to the bridle rings to hold the bit together and to permit flexing of the cheek and mouthpiece relative to each other;

spring means disposed inside of the flexible portion of each cheekpiece; and adjustable connectors, each of said adjustable connectors having a bore extending through the longitudinal axis thereof and offset from the lateral center of the adjustable connector and an aperture extending therethrough transversely to the bore and offset from the longitudinal center of the adjustable connector, each end of the mouthpiece having a bore therethrough extending transversely to the longitudinal axis thereof such that when the ends of the mouthpiece are threaded through the apertures of the adjustable connectors, the bores of the mouthpiece align with the bores of the adjustable connectors, thereby permitting passage of the flexible connecting means therethrough, to permit adjustment of the size and leverage of the bit by reversing the ends and sides of the adjustable connectors, and wherein, when a set of reins is attached to the rein connector, tensioning the reins in one direction will cause flexion of the bit, thereby turning the animal's head in the opposite direction of the tension.

9. The bit of claim 8 wherein the ends of the flexible connecting means may be detached from the bridle rings by compression of the external springs of the cheek pieces to permit ready disassembly and adjustment of the size of the bit.

10. A horse tack bit comprising:

a mouthpiece having two ends, with a bore adjacent each of said ends and extending transversely to the longitudinal axis of the mouthpiece;

two adjustable connectors each having a bore extending through the longitudinal axis thereof and offset from the center and an aperture extending therethrough transversely to the bore and offset from the center, wherein the ends of the mouthpiece may be threaded through the apertures of the adjustable connectors, thereby causing the bores of the mouthpiece to align with the bores of the adjustable connectors;

two opposed tubular cheekpieces, each of said cheekpieces including an angled shank portion attached to an end of an adjustable connector to extending rearwardly, downwardly and inwardly from the mouthpiece and a flexible portion including an externally disposed spring;

a bridle ring disposed at the end of each adjustable connector opposite the end attached to the cheekpiece;

spring means disposed inside of the flexible portion of each cheekpiece;

a Y-shaped rein connector having opposed arms and a central leg;

two flexible cables, one end of each cable being detachably attached to one of the arms of the Y-shaped rein connector, the other end being threaded through a cheekpiece and spring means disposed therein, and through the bore of a said adjustable connector and a said end of the mouthpiece, and detachably attached to a bridle ring to hold the bit together and permit flexing of the cheek and mouthpiece relative to each other; and a rein ring attached to the leg of the Y-shaped rein connector, the leg of the Y-shaped rein connector being angled backward and downward to exert a cantilever effect on the bit when a rein attached thereto is pulled, wherein, when a set of reins is attached to the rein ring, tensioning the reins in one direction will cause flexion of the bit and exert a cantilever effect thereon, thereby turning the animal's head in the opposite direction of the tension.

11. The bit of claim 10 wherein the ends of the flexible cables may be detached from the bridle rings and from the Y-shaped rein connector by compression of the internal springs to permit ready disassembly and adjustment of the size of the bit by reversing the ends and sides of the adjustable connectors.

12. A method of controlling the direction of a horse while being ridden including the steps providing the horse with a bridle and bit, said bit comprising:

a mouthpiece having two ends, with a bore adjacent each of said ends and extending transversely to the longitudinal axis of the mouthpiece;

two adjustable connectors each having a bore extending through the longitudinal axis thereof and offset from the center and an aperture extending therethrough and transverse to the bore and offset from the center, wherein the ends of the mouthpiece may be threaded through the apertures of the adjustable connectors, thereby causing the bores of the mouthpiece to align with the bores of the adjustable connectors;

two opposed tubular cheekpieces, each of said cheekpieces including an angled shank portion attached to an end of an adjustable connector to extend rearwardly, downwardly and inwardly from the mouthpiece and a flexible portion including an externally disposed spring;

a bridle ring disposed at the end of each adjustable connector opposite the end attached to the rein connector;

spring means disposed inside of the flexible portion of each cheekpiece;

a Y-shaped rein connector;

two flexible cables, one end of each cable being detachably attached to one of the arms of the Y-shaped rein connect, the other end being threaded through a cheekpiece and spring means disposed therein, and through the bore of an adjustable connector and an end of the mouthpiece, and detachably attached to a bridle ring to hold the bit together and permit flexing of the cheek and mouthpieces relative to each other; and a rein ring attached to the leg of the Y-shaped rein connector, the leg of the Y-shaped rein connector being angled backward and downward to exert a cantilever effect on the bit when a rein attached thereto is pulled;

attaching a set of reins to the Y-shaped rein connector; and exerting tension on the reins on one side of the horse's neck to cause flexion of the bit and to exert a cantilever effect thereon, thereby turning the horse's head in the opposite direction of the tension.

* * * * *